US010364651B2

(12) United States Patent
Stolboushkin et al.

(10) Patent No.: US 10,364,651 B2
(45) Date of Patent: Jul. 30, 2019

(54) VALVE AND METHOD

(71) Applicants: Eugene Stolboushkin, Houston, TX (US); Roy Woudwijk, Spring, TX (US); Joshua Raymond Snitkoff, Houston, TX (US); Tarik Abdelfattah, Houston, TX (US); Elmer Peterson, Porter, TX (US)

(72) Inventors: Eugene Stolboushkin, Houston, TX (US); Roy Woudwijk, Spring, TX (US); Joshua Raymond Snitkoff, Houston, TX (US); Tarik Abdelfattah, Houston, TX (US); Elmer Peterson, Porter, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 107 days.

(21) Appl. No.: 15/664,411

(22) Filed: Jul. 31, 2017

(65) Prior Publication Data

US 2019/0032450 A1 Jan. 31, 2019

(51) Int. Cl.

| | |
|---|---|
| ***E21B 34/14*** | (2006.01) |
| ***E21B 34/10*** | (2006.01) |
| ***E21B 23/00*** | (2006.01) |
| *E21B 34/00* | (2006.01) |
| *E21B 43/08* | (2006.01) |

(52) U.S. Cl.

CPC ..... *E21B 34/14* (2013.01); *E21B 23/006* (2013.01); *E21B 34/10* (2013.01); *E21B 43/08* (2013.01); *E21B 2034/007* (2013.01)

(58) Field of Classification Search

CPC ..... E21B 34/102; E21B 34/14; E21B 43/08; E21B 2034/007; E21B 23/006; E21B 34/085; E21B 43/082; E21B 43/088; E21B 34/10

See application file for complete search history.

(56) References Cited

U.S. PATENT DOCUMENTS

| | | | | |
|---|---|---|---|---|
| 3,974,876 | A * | 8/1976 | Taylor | E21B 17/003 166/66.4 |
| 6,003,605 | A * | 12/1999 | Dickson | E21B 34/10 166/324 |
| 6,675,897 | B1 * | 1/2004 | McGarian | E21B 21/103 166/151 |
| 8,596,366 | B2 * | 12/2013 | Franklin | E21B 34/066 166/332.1 |
| 8,602,110 | B2 * | 12/2013 | Kuo | E21B 43/12 166/205 |
| 2009/0078428 | A1 * | 3/2009 | Ali | E21B 34/08 166/373 |

(Continued)

*Primary Examiner* — Michael R Wills, III
(74) *Attorney, Agent, or Firm* — Cantor Colburn LLP

(57) ABSTRACT

A valve including a housing, a body having an aperture radially therethrough fluidly connecting a volume radially inwardly of the body with a volume radially outwardly of the body, a bulkhead sealedly disposed between the body and the housing, the bulkhead having a port therein, a piston extending through the bulkhead and sealed thereto, the piston having a bias end and a carrier end, a biasing member connected to the bias end of the piston, the piston exposed at a carrier end to fluid pressure from the volume radially inwardly of the body, a port closure operably connected to the piston.

16 Claims, 7 Drawing Sheets

(56) References Cited

U.S. PATENT DOCUMENTS

| | | | | |
|---|---|---|---|---|
| 2009/0151925 | A1* | 6/2009 | Richards | E21B 34/06 166/53 |
| 2011/0284233 | A1* | 11/2011 | Wu | E21B 10/32 166/321 |
| 2015/0300124 | A1* | 10/2015 | Mailand | E21B 34/102 166/332.8 |
| 2017/0370168 | A1* | 12/2017 | Farrar | E21B 23/006 |

* cited by examiner

VALVE AND METHOD

BACKGROUND

In the resource recovery industry, valves are required for fluid flow control for many different operations. Valves are used to facilitate formation treatment through boreholes, inflow control from formations into structure within boreholes, etc. Where such valves are to be placed in generally inaccessible areas, they are commonly preset or preselected for whatever function is desired of them. Greater flexibility of valves to allow multiple functions would increase efficiency in the industry and therefore would be desirable.

SUMMARY

A valve including a housing, a body having an aperture radially therethrough fluidly connecting a volume radially inwardly of the body with a volume radially outwardly of the body, a bulkhead sealedly disposed between the body and the housing, the bulkhead having a port therein, a piston extending through the bulkhead and sealed thereto, the piston having a bias end and a carrier end, a biasing member connected to the bias end of the piston, the piston exposed at a carrier end to fluid pressure from the volume radially inwardly of the body, a port closure operably connected to the piston.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
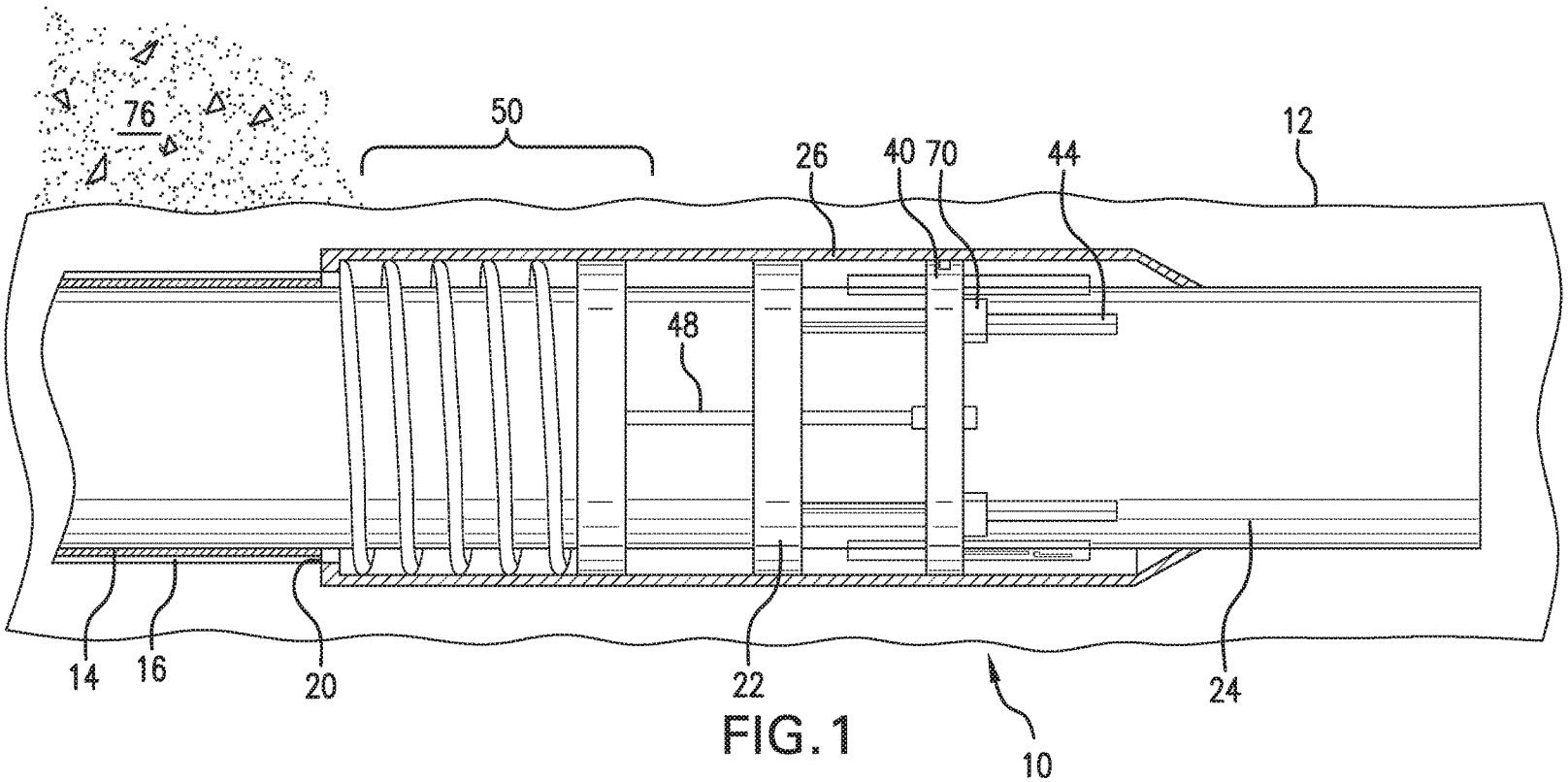
FIG. 1 is a cross sectional view of a valve in a run in position.
Figure 2:
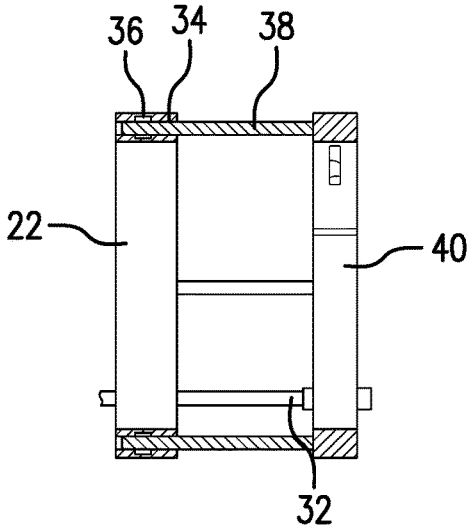
FIGS. 2-5 are various views of a bulkhead and piston carrier of FIG. 1 to promote understanding thereof.
Figure 11:
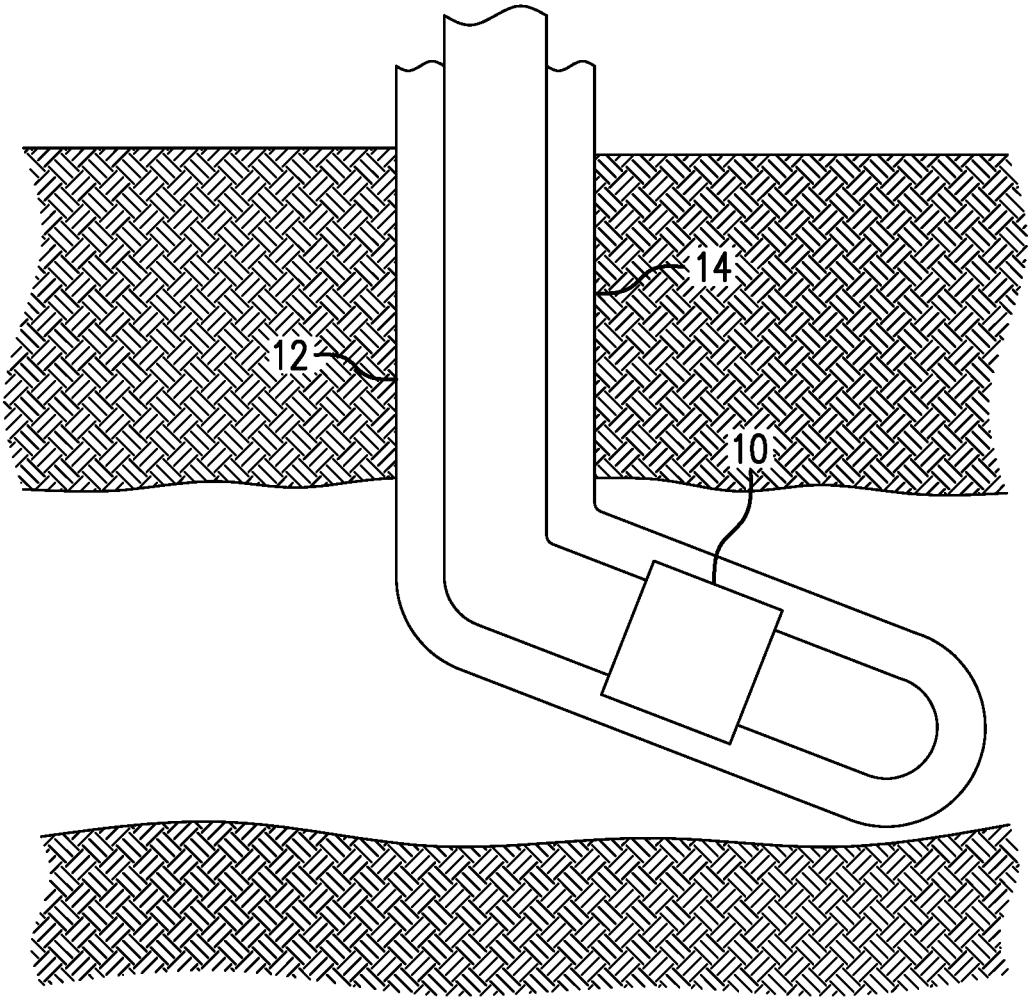
FIG. 11 is a general illustration of a borehole system including the valve illustrated in FIG. 1.

Referring to FIG. 1, a valve 10 is illustrated in a run in hole position in a borehole 12. In embodiments, the valve 10 may be a part of a string 14 and may be adjacent an inflow control device 16 such as a sand screen, a flow limiting or pressure drop managing configuration, etc. The valve 10 accordingly may form a part of a borehole system employed in the exploration and/or recovery of resources (see FIG. 11).

Figure 3:
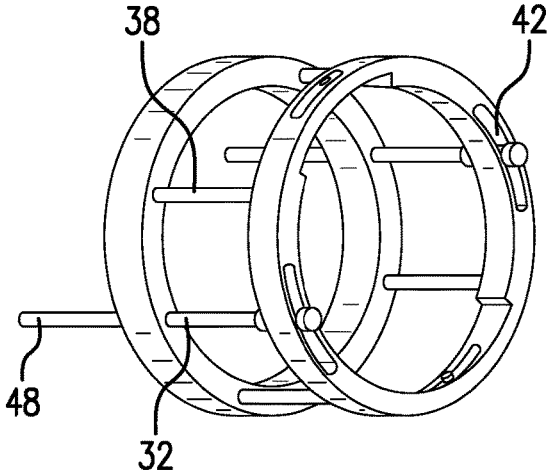
Figure 4:
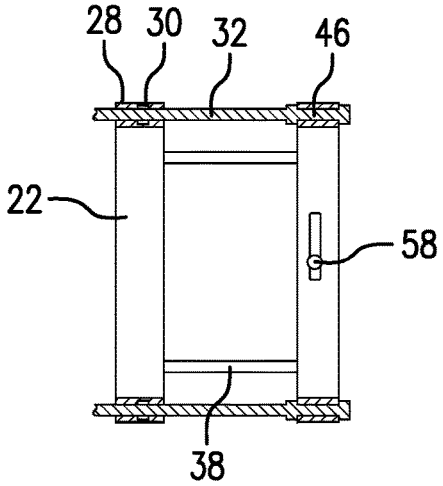
Figure 5:
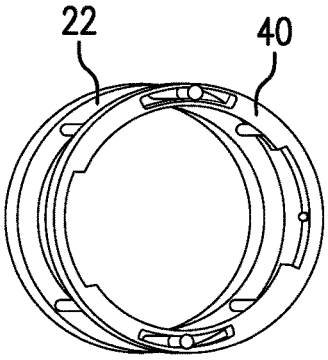
Figure 9:
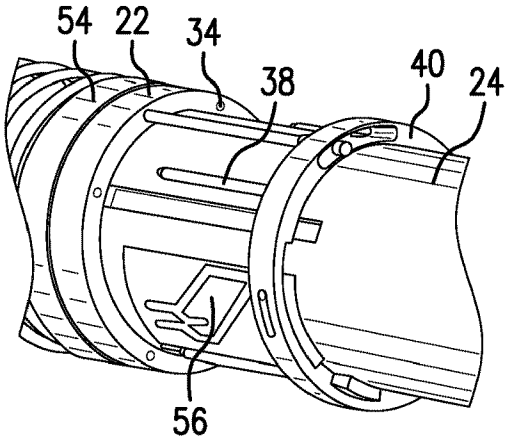
FIG. 9 is a perspective view of the same section as FIGS. 6-8 provided for the purpose of illustrating an optional feature of misaligning pins with flow ports.

Referring to FIGS. 2-5 along with FIG. 1, the valve 10 will be provided inflow potential from the inflow control device 16 at inlet 20. Fluid supplied thereto is free to flow to a bulkhead 22 that is sealedly connected to both between a body 24 and a housing 26 and fixedly attached to at least one of or both the body 24 and a housing 26. The bulkhead 22 includes at least one opening 28 therethrough (see FIG. 4) to sealingly (by seal 30), receive a piston 32. The seal 30 may be an O-ring type seal, a bonded seal, a metal-to-metal seal, etc. The seal 30 also may be disposed on the piston 32 rather than in the opening 28. There may be any number of openings 28, two illustrated, limited only by practicality. The actual diametric size of those openings and hence the piston area they ultimately represent will affect function of the valve 10 with respect to pressure up required for activity therefrom. Specifically, the smaller the diameter of the openings 28 the higher the applied pressure differential required assuming the same number of openings 28. A greater number of openings will increase the piston area and reduce the pressure up requirements. Determining the desired size and or number of openings for a particular embodiment is within the level of skill in the art. The openings 28 that exist within a particular embodiment's bulkhead remain sealed with the pistons 32 therein throughout the life of the valve 10. Aside from the openings 28, there is also at least one, and again any number may be used limited only by practicality, port 34 in the bulkhead 22 (see FIG. 2). Ports 34 are configured to allow fluid through the bulkhead 22 in certain positions of the valve 10 and disallow fluid flow therethrough in other positions of the valve 10. In embodiments, a seal 36 is employed to ensure sealing. The seal 36 may be an O-ring type seal, a bonded seal, a metal to metal seal, etc. The seal 36 also may be disposed on a mating part rather than in the opening 28. In this case, the mating part is a pin 38. Pin 38 is axially positionally fixed with the piston 32 such that it will move with the piston 32. In an embodiment, the pin 38 is connected to the piston 32 through a piston carrier 40. Accordingly, if the piston 32 moves, the pin 38 will move. In FIG. 3, it can be ascertained that in an embodiment, the connection between the piston 32 and the piston carrier 40 is a slot connection 42. This is an optional configuration that allows the piston carrier 40 to be rotated about its axis in certain positions of the valve 10 so that the pins 38 will not be aligned with the ports 34 (see FIG. 9). This can be beneficial in some circumstances in that flow through the ports 34 would not directly impinge on the pins 38 if they are rotated out of alignment with the ports 34. Such a configuration may prolong the service life of the valve 10.

With the pistons 32 connected at a carrier end 46 to the piston carrier 40, reference is made back to FIG. 1 where a bias end 48 of pistons 32 is visibly connected to a biasing member 50. Biasing member 50 comprises a spring 52 and a spring follower 54. The spring may be of any type including but not limited to a coil spring, an elastomeric spring, or any other resilient member. In an embodiment the spring follower 54 is a ring as illustrated. Biasing member 50 is configured to urge the piston 32 through the bulkhead 22 in a direction toward the piston carrier 40, resulting in the piston carrier 40 moving in that same direction.

Figure 6:
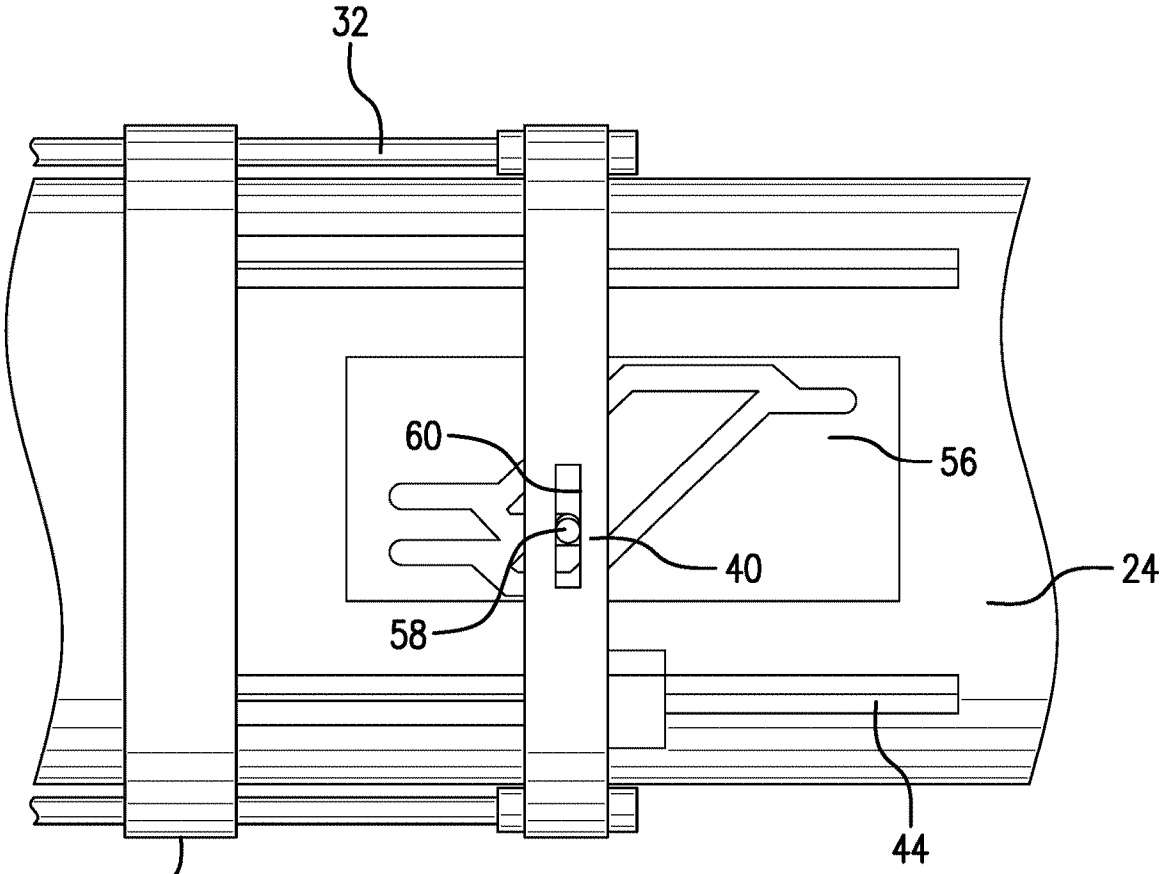
FIGS. 6-8 are enlarged views of a portion of FIG. 1 rotated 90 degrees to illustrate a J-slot mechanism of the valve in various positions.
Figure 7:
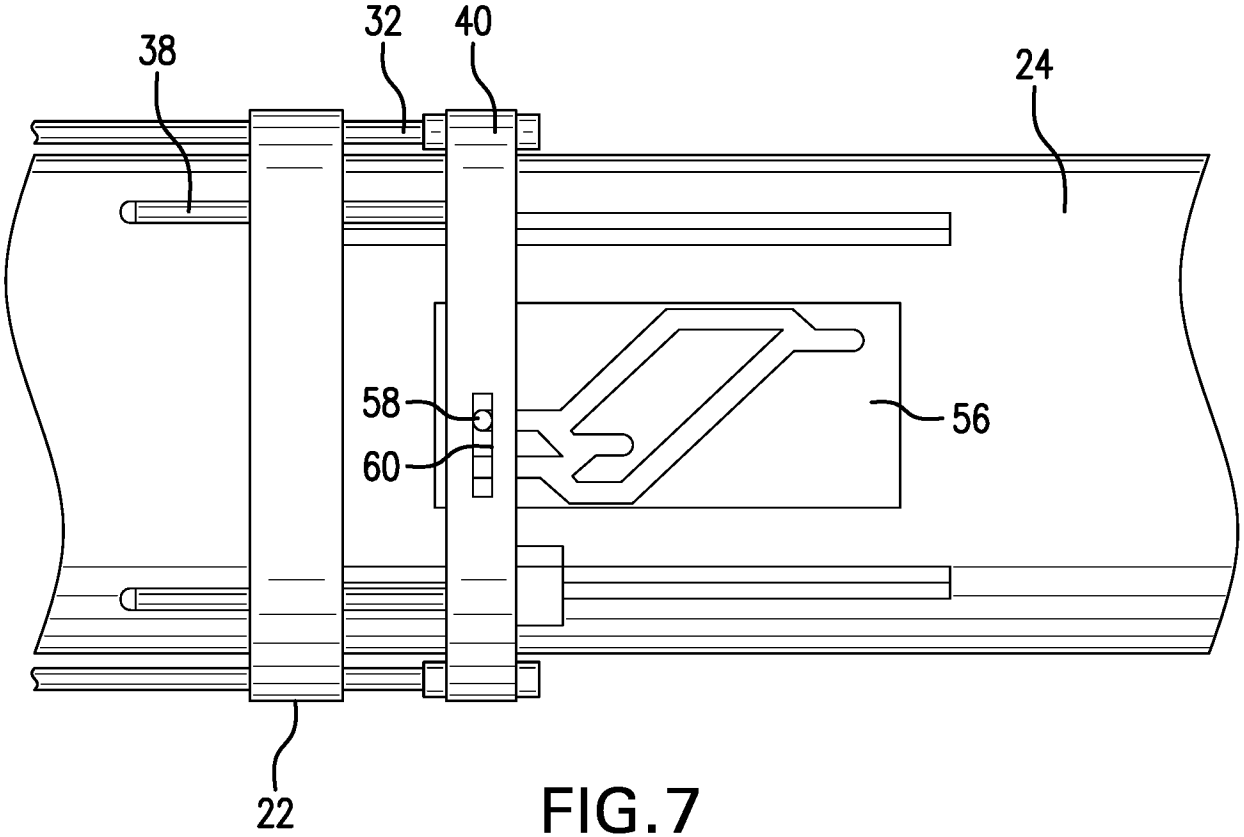
Figure 8:
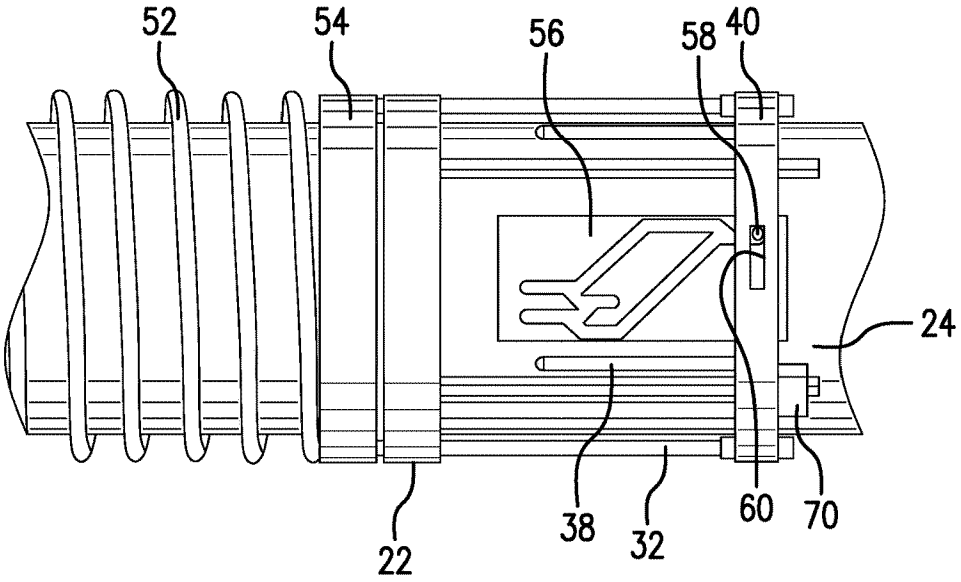

Prior to discussion of the operation of the valve 10, reference is made to FIGS. 6-8 wherein a j-slot 56 is illustrated with a j-slot follower 58 interacting with the piston carrier 40. FIG. 6 illustrates the run in hole position; FIG. 7 illustrates the position after pressure is applied (or mechanical actuation is undertaken) to the tubing string 14; and FIG. 8 illustrates the position after bleed-off of that applied pressure (or release of the mechanical impetus). It should be appreciated that the pins 38 are shown in FIG. 7 disposed in the ports 34. In this run in position (FIG. 6), no fluid may move through the bulkhead 22. In FIG. 7, pressure has been applied to the string 14 to act on the pistons through an aperture 44 in the body 24 (or for a mechanical actuation, a shifting tool inside the string has been used to act on the pistons 32) causing the pins 38 to still be in sealed relationship with the ports 34 but now can be seen extending therethrough. In this position, the bulkhead 22 is still sealed against fluid passage therethrough. Moving to FIG. 8, the position is one of pressure bleed off or mechanical release such that the pins 38 are moved out of engagement with the ports 34. Flow of fluid is hence permitted through the bulkhead 22.

It will be noted that the j-slot follower 58 interacts with the piston carrier 40 via a slot 60. In FIGS. 6 and 7, the position of the follower 58 in the j-slot 56 is acted upon by axial walls of the slot 60 but there is no contact between the follower 58 and radial end walls of the slot 60. In FIG. 8 however, it is apparent that the follower 58 is in contact with an end wall of slot 60 such that impetus on the follower 58 from the j-slot 56, will cause the rotational movement of the piston carrier described above resulting in the rotating of the pins 38 out of alignment with the ports 34. Again it is noted that this feature is optional but may enhance service life of the valve 10.

Figure 10:
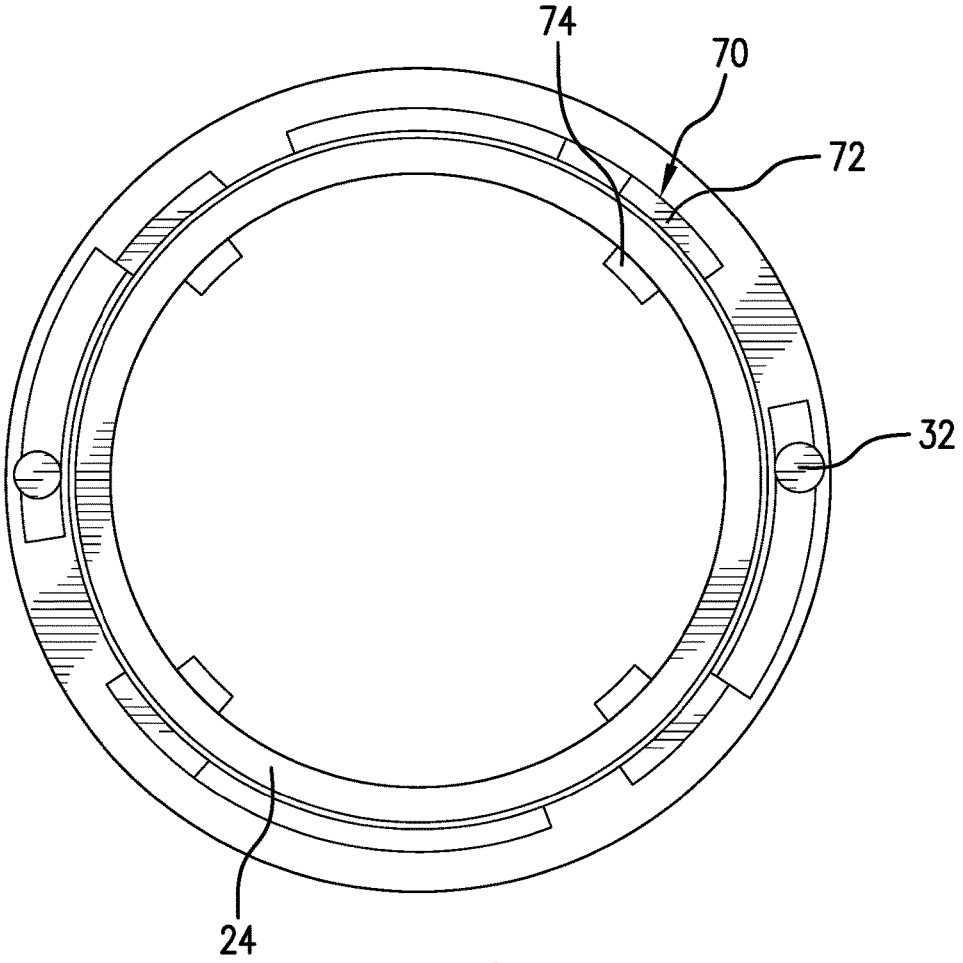
FIG. 10 is a cross sectional illustration taken through the piston carrier illustrating primarily a set of keys.

Finally noted is keys 70 that are visible in several of the Figures. Reference is particularly made to FIGS. 1 and 10 for discussion thereof. Keys 70 are provided as a mechanical backup configuration in case hydraulic pressure actuation fails or is impeded. The keys 70 include on outer section 72 and an extension 74 that when positioned in the valve 10 extends thorough the aperture 44 of the body 24 thereby providing physical access to the keys 70 by a shifting tool run inside of the string 14. The keys may simply float in the aperture 44 since they are bounded outwardly by the housing 26 and inwardly the outer section 72 is larger than the aperture 44. Hence the keys 70 cannot simply fall out of the body 24. The function of the keys will become clearer below. Also important about the keys is that they facilitate the construction of the valve as taught herein using as-rolled pipe rather than a machined housing threaded onto a pipe. More specifically, because the keys are dropped into the apertures 44 of body 24, it is not necessary to employ a machined component for body 24 as would be needed to assemble prior art valve systems (though of course, a machined component could be used for the valve taught herein if desired). This saves considerable cost in the manufacture of the valve taught herein in iterations where an as-rolled pipe is used for body 24.

In operation, the valve 10 is disposed in a string 14 and either has a source of fluid that has been delivered thereto post inflow control device (ICD) or in some iterations, the bulkhead 22 may be configured as the ICD itself and hence the source of fluid would simply be the formation 76 outside the borehole 12. In the run in position, as illustrated in FIG. 1, the bulkhead is sealed to fluid flow. When fluid flow through the bulkhead 22 is desired, an operator, or a controller if the system is automated, will increase applied pressure within the string 14. The pressure acts on the pistons 32 causing them to move leftwardly in FIG. 1. This will compress the biasing member 50 and at the same time cause the follower 58 to move within the j-slot 56. Reduction or bleed off of pressure allows the biasing member 50 to force the pistons 32, and anything connected to them like the piston carrier 40 pins 38, etc. to move in a direction opposite the direction in which they moved under the impetus of the applied hydraulic pressure, or rightwardly in FIG. 1. This motion causes the follower 58 to move again in the j-slot 56 to another position which allows the valve 10 to attain a different position than the run in position. The new position is one in which the pins 38 have completely disengaged from the bulkhead 22, thereby leaving the ports 34 open so that fluid may flow therethrough. In this position, fluid from the source (an ICD, or the formation) may continue through bulkhead 22 and into apertures 44 into the string 14 for production. Depending upon the configuration of the j-slot 56 and the piston carrier 40, the optional function of rotating the pins 38 out of the erosional path of fluid flowing through the ports 34 may be attained. In connection with the above, it is important to note that the actual opening movements as disclosed herein occur during a pressure bleed off phase rather than during a pressure up phase. This overcomes issues with some prior art systems where the opposite is true. When a prior art system opens on pressure up and only one or a few of say 40 burst disks (for example) bursts, then pressure will be diverted to the formation rather than applied to the remaining burst disks resulting in possibly only one or only a few of the total number of stages being actuated.

In the event that the hydraulic actuation of valve 10 is ineffective or unavailable, the keys 70 become important. A shifting tool (not shown but well known) can be run in the string 14 to engage the extensions 74. Pulling on those extensions 74 will have the same effect on the pistons 32 that the applied pressure should have and accordingly the valve 10 may be cycled identically by using the applied pressure route or the shifting tool route. The keys also allow for the valve 10 to be reset to the run in position through further action in the j-slot 56 that would not be available using the applied pressure route since once the ports 34 are open, pressure is no longer effective in cycling the valve 10.

Set forth below are some embodiments of the foregoing disclosure:

Embodiment 1

A valve including a housing, a body having an aperture radially therethrough fluidly connecting a volume radially inwardly of the body with a volume radially outwardly of the body, a bulkhead sealedly disposed between the body and the housing, the bulkhead having a port therein, a piston extending through the bulkhead and sealed thereto, the piston having a bias end and a carrier end, a biasing member connected to the bias end of the piston, the piston exposed at a carrier end to fluid pressure from the volume radially inwardly of the body, a port closure operably connected to the piston.

Embodiment 2

The valve as in any prior embodiment wherein the port or the port closure includes a seal interactive with the other of the port or the port closure in selected positions of the valve.

Embodiment 3

The valve as in any prior embodiment wherein the port closure is a pin.

Embodiment 4

The valve as in any prior embodiment wherein the bias end of the piston is configured to be exposed to fluid pressure segregated from the fluid pressure from the volume radially inwardly of the body such that in the event of a differential pressure experienced across the bulkhead during use, the piston will move.

Embodiment 5

The valve as in any prior embodiment further comprising a piston carrier attached to the one end of the piston.

Embodiment 6

The valve as in any prior embodiment wherein the piston carrier supports the port closure.

Embodiment 7

The valve as in any prior embodiment wherein the piston carrier is rotatably engaged with the piston.

Embodiment 8

The valve as in any prior embodiment wherein the rotatability of the piston carrier relative to the piston effects alignment or misalignment of the port closure with the port in the bulkhead to protect the port closure from erosion when the port is open.

Embodiment 9

The valve as in any prior embodiment wherein the biasing member is a spring follower and a compression spring biased against piston movement pursuant to actuation.

Embodiment 10

The valve as in any prior embodiment wherein the actuation is application of pressure.

Embodiment 11

The valve as in any prior embodiment wherein the actuation is via shifting tool.

Embodiment 12

The valve as in any prior embodiment further comprising a J-slot mechanism operably connected to the piston.

Embodiment 13

The valve as in any prior embodiment wherein the operable connection between the j-slot and the piston is through a pin follower engaged with the j-slot and engaged with a piston carrier attached to the piston.

Embodiment 14

The valve as in any prior embodiment wherein the piston carrier includes a slot receptive to the pin follower to allow pin movement while navigating the j-slot and for piston carrier rotation when the pin moves to one end of the slot.

Embodiment 15

The valve as in any prior embodiment further comprising a key interactive with the piston and extending through the aperture and configured to be engagable with a shifting tool to actuate the valve mechanically.

Embodiment 16

The valve as in any prior embodiment wherein the body is as-rolled pipe.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A valve comprising:

a housing;

a body having an aperture radially therethrough fluidly connecting a volume radially inwardly of the body with a volume radially outwardly of the body;

a bulkhead sealedly disposed between the body and the housing, the bulkhead having a port therein;

a piston extending through the bulkhead and sealed thereto, the piston having a bias end and a carrier end;

a biasing member connected to the bias end of the piston, the piston exposed at a carrier end to fluid pressure from the volume radially inwardly of the body;

a port closure operably connected to the piston.

2. The valve as claimed in claim 1 wherein the port or the port closure includes a seal interactive with the other of the port or the port closure in selected positions of the valve.

3. The valve as claimed in claim 1 wherein the port closure is a pin.

4. The valve as claimed in claim 1 wherein the bias end of the piston is configured to be exposed to fluid pressure segregated from the fluid pressure from the volume radially inwardly of the body such that in the event of a differential pressure experienced across the bulkhead during use, the piston will move.

5. The valve as claimed in claim 1 further comprising a piston carrier attached to the one end of the piston.

6. The valve as claimed in claim 5 wherein the piston carrier supports the port closure.

7. The valve as claimed in claim 5 wherein the piston carrier is rotatably engaged with the piston.

8. The valve as claimed in claim 7 wherein the rotatability of the piston carrier relative to the piston effects alignment or misalignment of the port closure with the port in the bulkhead to protect the port closure from erosion when the port is open.

9. The valve as claimed in claim 1 wherein the biasing member is a spring follower and a compression spring biased against piston movement pursuant to actuation.

10. The valve as claimed in claim 9 wherein the actuation is application of pressure.

11. The valve as claimed in claim 9 wherein the actuation is via shifting tool.

12. The valve as claimed in claim 1 further comprising a J-slot mechanism operably connected to the piston.

13. The valve as claimed in claim 12 wherein the operable connection between the j-slot and the piston is through a pin follower engaged with the j-slot and engaged with a piston carrier attached to the piston.

14. The valve as claimed in claim 13 wherein the piston carrier includes a slot receptive to the pin follower to allow pin movement while navigating the j-slot and for piston carrier rotation when the pin moves to one end of the slot.

15. The valve as claimed in claim 1 further comprising a key interactive with the piston and extending through the aperture and configured to be engagable with a shifting tool to actuate the valve mechanically.

16. The valve as claimed in claim 1 wherein the body is as-rolled pipe.

* * * * *